US009414176B2

(12) United States Patent
Cimaz et al.

(10) Patent No.: US 9,414,176 B2
(45) Date of Patent: Aug. 9, 2016

(54) ACCESSORY PLUG DETECTION

(71) Applicant: STMicroelectronics International N.V., Amsterdam (NL)

(72) Inventors: Lionel Cimaz, Pleumeleuc (FR); Stephane Le Coq, Thorigne Fouillard (FR)

(73) Assignee: STMICROELECTRONICS INTERNATIONAL N.V., Amsterdam (NL)

( * ) Notice: Subject to any disclaimer, the term of this patent is extended or adjusted under 35 U.S.C. 154(b) by 82 days.

(21) Appl. No.: 14/485,945

(22) Filed: Sep. 15, 2014

(65) Prior Publication Data

US 2015/0078577 A1 Mar. 19, 2015

(30) Foreign Application Priority Data

Sep. 16, 2013 (EP) ..... 13306262

(51) Int. Cl.
*H04R 1/10* (2006.01)
*H04R 29/00* (2006.01)

(52) U.S. Cl.
CPC ..... *H04R 29/004* (2013.01); *H04R 29/001* (2013.01); *H04R 1/10* (2013.01); *H04R 2420/05* (2013.01)

(58) Field of Classification Search
CPC ..... H04R 1/1041; H04R 5/033
USPC ..... 381/74, 384
See application file for complete search history.

(56) References Cited

U.S. PATENT DOCUMENTS

2005/0201568 A1* 9/2005 Goyal ..... H04M 1/6058 381/74
2008/0164994 A1* 7/2008 Johnson ..... H01R 13/703 340/533

* cited by examiner

*Primary Examiner* — Paul S Kim
*Assistant Examiner* — Katherine Faley
(74) *Attorney, Agent, or Firm* — Gardere Wynne Sewell LLP

(57) ABSTRACT

The presence and/or state of an accessory having a connector of a first type (e.g. male connector) adapted to be plug into a connector of a second type (e.g. female connector) of an electronic device is detected based on an analysis of an electrical line coupled to the female connector of the device, wherein the electrical line analysis is started only when it is determined that the connector of the accessory is completely inserted into the connector of the device.

31 Claims, 1 Drawing Sheet

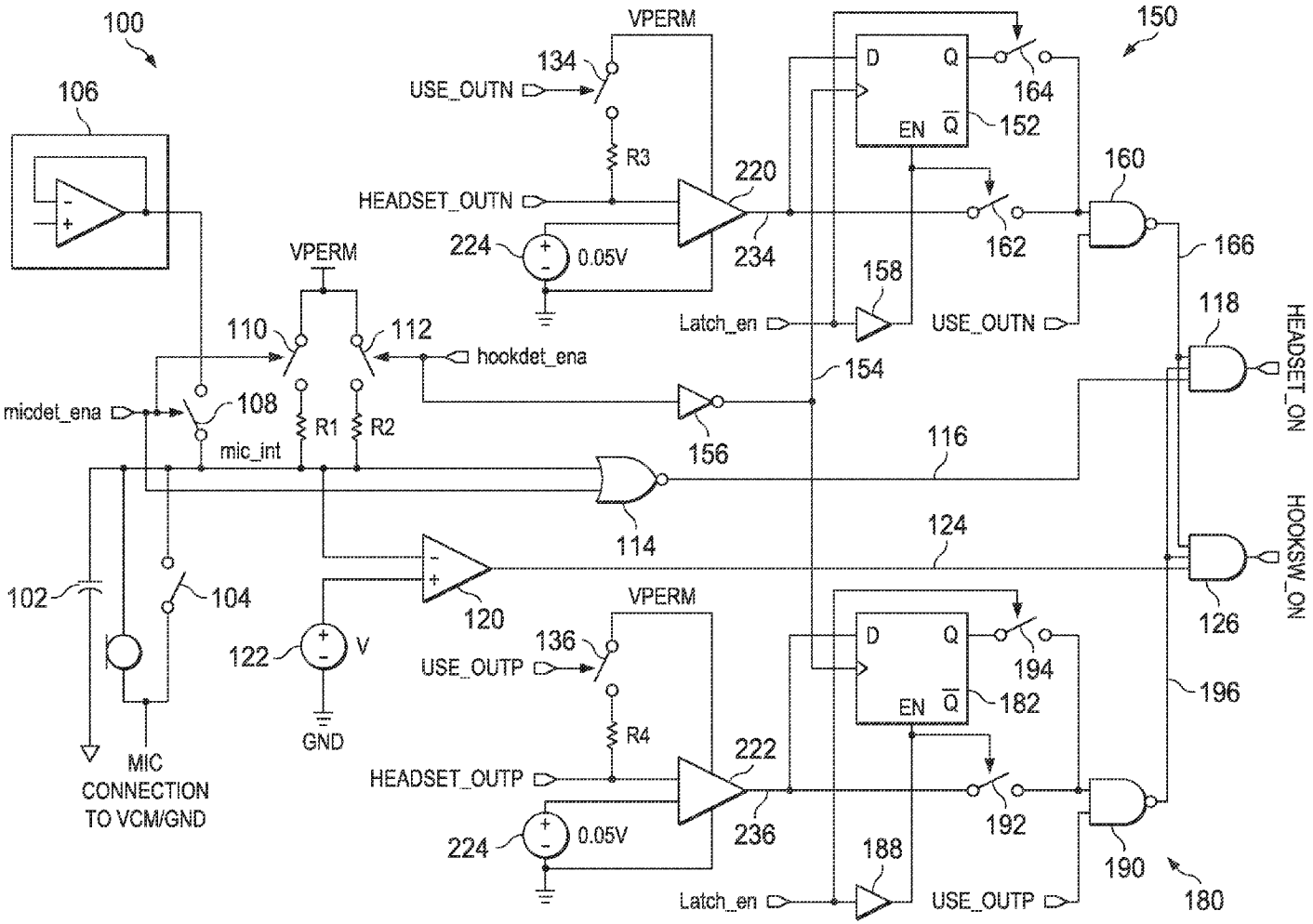
HEADSET_ON
HOOKSW_ON
150
180
100
106
102
104
108
110
112
114
116
118
120
122
124
126
134
136
152
154
156
158
160
162
164
166
182
188
190
192
194
196
220
222
224
224
234
236
R1
R2
R3
R4
0.05V
0.05V
V
GND
VPERM
VPERM
VPERM
USE_OUTN
USE_OUTN
USE_OUTP
USE_OUTP
HEADSET_OUTN
HEADSET_OUTP
Latch_en
Latch_en
hookdet_ena
mic_int
micdet_ena
MIC CONNECTION TO VCM/GND
D
Q
EN
Q̄
D
Q
EN
Q̄

ACCESSORY PLUG DETECTION

PRIORITY CLAIM

This application claims priority from European Application for Patent No. 13306262.0 filed Sep. 16, 2013, the disclosure of which is incorporated by reference.

TECHNICAL FIELD

The present invention generally relates to accessory plug detection, namely the detection of the presence and/or state of an accessory plug into an electronic device. It finds applications, in particular, in mobile terminal systems, e.g., cell phones, smart phones, etc.

BACKGROUND

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

In some mobile devices, e.g., mobile phones, a user interface may be adapted for detecting headset or headphone plug into the device. Headsets may thus embed push buttons (called hookswitch), which may be used not only to initiate or terminate calls, but also to control the music player (and operate functions such as "play", "pause", "mute", etc.). A process of detecting the headset/headphone presence and any button press may run permanently, with the constraint of thus being a low power process. In addition, the headset/headphones are nowadays available mainly with male jack connectors, for instance with 2.5 mm or 3.5 mm diameter plug.

A solution which may be employed for detecting headset/headphone presence may use a specific female jack connector integrated in the phone. Such a female jack connector may be specific in that a contact is added in the connector which comes open or closed depending on whether a male jack plug is inserted or not. This contact allows detecting headset/headphone presence.

An alternative solution may consist in detecting the headset by analyzing the microphone presence. In fact the microphone line could be open when nothing is plugged, resistively loaded to a few kilo-ohms when the headset microphone (or mike) is connected, resistively loaded to a few hundreds ohms when the headset buttons are pressed, and nearly shorted to ground when headphone is plugged.

The use of specific female jack connector only teaches about jack male presence or insertion. Hence, it is not useful to distinguish between headset, headphone and button press. Even if it allows a low power detection of jack male presence, concluding about the effective accessory being connected or about the state of buttons would require use of analog to digital conversion which is current consuming. This current consumption could be problematic because of permanent detection requirement. In addition, the presence of the specific presence contact on this female jack connector raises the cost of said jack connector.

The above alternative solution consisting in detecting the microphone presence allows the use of the most basic and lowest cost female jack connector, because no specific contact is required. It allows a full detection of the accessory plugged-in as well as the acquisition of button press state. Finally, it exhibits low current consumption, particularly when the detection is pulsed.

However, this solution shows a particular drawback depending on how the jack male connector is inserted in the phone. This phenomenon is known as "sliding effect". During insertion, the male jack is in fact sliding inside the female plug. As the jack contacts are populated across the length of connector, the electrical connection of all contacts is sequential. In addition, the sequence of contact connection is false while jack male is not fully inserted in the female connector. For example, the tip contact of male jack (top contact) slides on all ring contacts of the female connector before being effectively linked to the tip contact of the female plug.

Effective issues of sliding effect comprise wrong detection of the headset and hook switch when the headset is plugged. It is observed, indeed, that the male connector rings cross different contacts and makes short cut which may result in connection between the headset left channel and the microphone for example.

There is a need in the art to address at least some of the above problems. In particular, embodiments allow avoiding the above described sliding wrong detection phenomenon.

SUMMARY

A first aspect relates to a method of detecting the presence and/or state of an accessory having a connector of a first type (e.g. male connector) adapted to be plug into a connector of a second type (e.g. female connector) of an electronic device, based on an analysis of an electrical line coupled to the female connector of the device, wherein the electrical line analysis is started only when it is determined that the connector of the accessory is completely inserted into the connector of the device.

The accessory may be, for instance, a headset or a headphone, and may have a hook switch. The device may be a wireless device such as a mobile terminal of a telecommunication system, e.g., a cell phone, smart phones, etc. In examples of embodiments, the connector of the accessory may be a male jack connector. The connector of the device may be a female jack connector with corresponding characteristics. The female jack connector may be adapted for the plugging of a microphone into the device. The electrical line may thus be a microphone (mike) line. The line analysis may be, for instance an impedance analysis or a voltage analysis. The accessory may embed at least one push button, called a hookswitch in the context of mobile phones, which is adapted to change the electrical line impedance or voltage in a manner that allows the state of the electrical line (and thus the operative state of the accessory) to be detected.

The headset/headphone/hookswitch presence and state detection is based on the analysis of the microphone electrical line. Embodiments rely on starting the microphone line analysis only when the male jack connector is completely inserted into the female jack connector. This removes all issues due to the sliding effect mentioned in the introduction.

A second aspect relates to a computer program product comprising one or more stored sequences of instructions that are accessible to a processor and which, when executed by the processor, cause the processor to carry out the steps of the method of the first aspect.

A third aspect relates to an apparatus having a detection unit adapted to detect the presence and/or state of an accessory having a connector of a first type (e.g. male connector) adapted to be plug into a connector of a second type (e.g. female connector) of the device to which an electrical line of the device is coupled. The detection unit is adapted to carry out the detection based on an analysis of the electrical line. The electrical line analysis is started only when it is determined that the connector of the accessory is completely inserted into the connector of the device.

A fourth aspect relates to a wireless electronic device comprising an apparatus according to the third aspect.

BRIEF DESCRIPTION OF THE DRAWINGS

The present invention is illustrated by way of example, and not by way of limitation, in the figures of the accompanying drawings, in which like reference numerals refer to similar elements and in which:

FIG. 1 is a schematic view of an example of embodiment of a device.

DETAILED DESCRIPTION OF THE DRAWINGS

In the following description, embodiments will be explained while taking the non-limiting example of a headset for a mobile phone, for the sake of least complexity. It will be appreciated, however, that embodiments may encompass other types of accessories including a headphone, a microphone, a cable for connecting the device to another device, etc. Similarly, embodiments may be applied to a device different of a mobile phone, for instance another mobile terminal system, smart phone, digital walkman, play station, etc.

Embodiments broadly rely on measuring the impedance on the output channels (out left and out right) before allowing the analysis of the microphone line to start. In fact, the loads on these channels are below 50 ohms when effectively connected to the headset speakers.

Advantages of this load analysis comprise the fact that one of the most popular jack contact assignments places the output channels at the top of the connector. These contacts are then to be the last ones connected. Detecting load on these lines is a reliable indication of the jack complete insertion.

Another popular jack contact assignment consists in placing the mike line at the top of the connector, followed by output channels. This configuration may even be less sensitive to the sliding effect as the microphone line gets connected only when the jack is fully inserted. That is said, experience shows that just before being completely inserted, the jack male microphone contact can connect the jack female microphone contact with the output left contact. This short cut results again in wrong accessory detection.

In variants or in addition, embodiments may further rely on synchronizing the impedance evaluation of the output channels with the microphone load evaluation, using e.g. low value pull-up resistance or similar mechanism. Because the microphone pull-up capacity is strong, the contact shorting effect does not result in concluding that output lines are connected together. Hence, the microphone load evaluation result may be ignored and so wrong detection may be avoided.

This avoids wrong detection of the headset which generally results in creating some wrong hook switch press by the user.

Further, it keeps the costs low because it allows using the most basic female jack connector.

Still further, it operates with low current consumption as pulsed detection is still doable.

Finally, it doesn't require allocation of other, potentially complex and costly electronic circuit such as Analog-to-Digital Converter (ADC) or other comparators.

Actually, the headset presence detection relies on the presence of the microphone. There is a high value pull-up resistor mechanism which biases the microphone pin. When the microphone voltage is below a given voltage threshold, the microphone is considered to be present and thus the headset is considered to be inserted.

Referring to FIG. 1, there is shown therein a schematic view of an example of embodiment of a circuit 100 implementing the proposed solution. In FIG. 1, the following references are used:

HEADSET_OUTP: headset output channel P line;
HEADSET_OUTN: headset output channel N line;
USE_OUTP: enable the pull up on the Headset output channel P;
USE_OUTN: enable the pull up on the Headset output channel N;
HEADSET_ON: indicate the state of the headset;
HOOKSW_ON: indicate the state of the hook switch;
high Z: High impedance state; and
VPERM: voltage reference.

As will be appreciated from FIG. 1, embodiments may be implemented by using only an analog mechanism and basic logic gates.

A signal line mic_int is coupled through a capacitor 102 to a ground reference. This line mic_int may, for example, comprise a line associated with a female jack. A microphone (mic) may be coupled between the line mic_int and a reference node (comprising ground or a common mode voltage), this operation occurring in association with the insertion of a male jack into the female jack. Furthermore, a hook switch 104 may be coupled between the line mic_int and the same reference node. The line mic_int receives a bias signal generated by a microphone bias circuit 106. The signal is selectively applied to the line mic_int through a switch 108 that is controlled by a microphone detect enable signal (micdet_ena).

The line mic_int is further biased to a voltage reference VPERM through a first resistor R1 and switch 110 that is controlled by the microphone detect enable signal (micdet_ena). The line mic_int is still further biased to the voltage reference VPERM through a second resistor R2 and switch 112 that is controlled by a hook switch detect enable signal (hookdet_ena).

A logic-NOR gate 114 logically combines the signal on line mic_int with the microphone detect enable signal (micdet_ena) to generate a headset on signal on line 116. A logic-AND gate 118 functions as a gating circuit to selectively gate the received headset on signal from line 116 to output the HEADSET_ON signal indicative of the state of the headset.

A comparator circuit 120 compares the signal on line mic_int with a voltage reference (V) 122 to generate a hook switch on signal on line 124. A logic-AND gate 126 functions as a gating circuit to selectively gate the received hook switch on signal from line 124 to output the HOOKSW_ON signal indicative of the state of the hook switch 104.

The HEADSET_OUTN line is initially biased to a voltage reference VPERM via a high value resistor R3 through switch 134. The resistor R3 may, for example, have a resistance of 100 kOhms. A comparator 220 functions to compare the voltage on the HEADSET_OUTN line to a reference voltage (for example, 0.05V) 224 and generate an output signal on line 234.

The HEADSET_OUTP line is initially biased to the voltage reference VPERM via a high value resistor R4 through switch 136. The resistor R4 may, for example, have a resistance of 100 kOhms. A comparator 222 functions to compare the voltage on the HEADSET_OUTP line to a reference voltage (for example, 0.05V) 224 and generate an output signal on line 236.

A first latch circuit 150 includes a flip-flop 152 whose data input (D) is coupled to receive the output signal from line 234.

The clock input (>) of the flip-flop 152 receives a signal on line 154 that is derived from the hook switch detect enable signal (hookdet_ena). More specifically, the signal on line 154 is generated by a logic inverter 156 whose input is coupled to receive the hook switch detect enable signal (hookdet_ena). The enable input (EN) of the flip-flop 152 receives a signal derived from a latch enable signal (latch_en) after logic inversion by a logic inverter 158. A logic-NAND gate 160 has a first input configured to receive the USE_OUTN signal which enables the pull up on the Headset output channel N. A second input of the gate 160 is configured to selectively receive either the output signal from line 234 or the output (Q) from the flip-flop 152. This selection operation is managed by a switch 162 that is actuated in response to the same signal applied to the enable input (EN) of the flip-flop 152, and further by a switch 164 that is actuated in response to the latch enable signal (latch_en). The logic-NAND gate 160 generates a first gating control signal on line 166 that is applied to the inputs of both the logic-AND gate 118 and the logic-AND gate 126.

A second latch circuit 180 includes a flip-flop 182 whose data input (D) is coupled to receive the output signal from line 236. The clock input (>) of the flip-flop 182 receives the signal on line 154 that is derived from the hook switch detect enable signal (hookdet_ena). The enable input (EN) of the flip-flop 182 receives a signal derived from the latch enable signal (latch_en) after logic inversion by a logic inverter 188. A logic-NAND gate 190 has a first input configured to receive the USE_OUTP signal which enables the pull up on the Headset output channel P. A second input of the gate 190 is configured to selectively receive either the output signal from line 236 or the output (Q) from the flip-flop 182. This selection operation is managed by a switch 192 that is actuated in response to the same signal applied to the enable input (EN) of the flip-flop 182, and further by a switch 194 that is actuated in response to the latch enable signal (latch_en). The logic-NAND gate 190 generates a second gating control signal on line 196 that is applied to the inputs of both the logic-AND gate 118 and the logic-AND gate 126.

When the headset is plugged in, the HEADSET_OUTP and HEADSET_OUTN signals are applied to the inputs of the comparators 20 and 22. When the HEADSET_OUTP and HEADSET_OUTN inputs fall below the reference voltage defining a detection threshold (due to the low impedance of the speaker of the headset), the HEADSET_ON and HOOK-SW_ON signals are gated by the action of signals 166 and 196.

The latch mechanisms 150 and 180 function to limit the risk of very low impedance on the HEADSET_OUTP and HEADSET_OUTN lines during short cut.

When the headset is detected, the USE_OUTP and USE_OUTN are then cleared and the detection comes back to standard detection scheme which is based on a microphone line analysis (this standard detection scheme analysis being known to those skilled in the art.

It should be noted that the hook switch state evaluation scheme is also based on the microphone voltage, namely on the microphone line analysis, however, through actuation of switch 112 this operation is performed with microphone line mic_int being biased to VPERM with a lower resistance value pull up resistor R2. Thus, when the hook is pressed by the user, the microphone line is shorted to ground.

In some embodiments, a pulsed detection scheme may comprise repeatedly executing, for example periodically, the phases, namely, in the considered example:

1/ Biasing the microphone with high value resistance and concluding on microphone presence or hook switch press state;

2/ Biasing the microphone with low value resistance and concluding on hook switch press state only; and, 3/ Stopping all bias on the microphone line and going into a low power mode.

Embodiments add the capability to detect the headset presence when the impedance on output lines is low, for instance less than 50 Ohms.

The detection method can be embedded in a computer program product, which comprises all the features enabling the implementation of the steps described herein, and which—when loaded in an information processing system—is able to carry out these steps. Computer program means or computer program in the present context mean any expression, in any language, code or notation, of a set of instructions intended to cause a system having an information processing capability to perform a particular function either directly or after either or both of the following a) conversion to another language. Such a computer program can be stored on a computer or machine readable medium allowing data, instructions, messages or message packets, and other machine readable information to be read from the medium. The computer or machine readable medium may include non-volatile memory, such as ROM, Flash memory, Disk drive memory, CD-ROM, and other permanent storage. Additionally, a computer or machine readable medium may include, for example, volatile storage such as RAM, buffers, cache memory, and network circuits. Furthermore, the computer or machine readable medium may comprise computer or machine readable information in a transitory state medium such as a network link and/or a network interface, including a wired network or a wireless network, that allow a device to read such computer or machine readable information.

Expressions such as "comprise", "include", "incorporate", "contain", "is" and "have" are to be construed in a non-exclusive manner when interpreting the description and its associated claims, namely construed to allow for other items or components which are not explicitly defined also to be present. Reference to the singular is also to be construed in be a reference to the plural and vice versa.

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, an embodiment of the present invention may not include all of the features described above. Therefore, it is intended that the present invention not be limited to the particular embodiments disclosed, but that the invention include all embodiments falling within the scope of the invention as broadly defined above.

A person skilled in the art will readily appreciate that various parameters disclosed in the description may be modified and that various embodiments disclosed and/or claimed may be combined without departing from the scope of the invention.

What is claimed is:

1. An apparatus, comprising:

a microphone detection circuit configured to detect connection of a microphone to a signal line through a jack connection and generate a first connection signal, wherein the microphone detection circuit comprises a logic gate configured to logically combine a voltage on said signal line with an enable signal;

a headset detection circuit configured to detect connection of a headset through said jack connection and generate a gating signal; and a gating circuit configured to pass said first connection signal for output as a headset connected signal in response to said gating signal.

2. The apparatus of claim 1, wherein the headset detection circuit comprises:

a first detection circuit coupled to a positive headset output channel of the headset and comprising a first comparator configured to compare a signal on the positive headset output channel to a first reference and generate a positive headset detect signal; and a second detection circuit coupled to a negative headset output channel of the headset and comprising a second comparator configured to compare a signal on the negative headset output channel to a second reference and generate a negative headset detect signal;

wherein the gating signal represents assertion of both the positive and negative headset detect signals.

3. The apparatus of claim 2, wherein the first detection circuit further comprises:

a flip-flop having a data input coupled to an output of the first comparator; and a switching circuit configured to selectively pass either an output from the flip-flop or the output of the first comparator as the positive headset detect signal in response to whether the flip-flop has been enabled.

4. The apparatus of claim 3, wherein the positive headset detect signal is selectively gated in response to whether a pull up on the positive headset output channel has been actuated in response to a pull-up control signal.

5. The apparatus of claim 4, further comprising a pull-up circuit including said pull up which is selectively actuated on the positive headset output channel by said pull-up control signal.

6. The apparatus of claim 2, wherein the second detection circuit further comprises:

a flip-flop having a data input coupled to an output of the second comparator; and a switching circuit configured to selectively pass either an output from the flip-flop or the output of the second comparator as the negative headset detect signal in response to whether the flip-flop has been enabled.

7. The apparatus of claim 6, wherein the negative headset detect signal is selectively gated in response to whether a pull up on the negative headset output channel has been actuated in response to a control signal.

8. The apparatus of claim 7, further comprising a pull-up circuit including said pull up which is selectively actuated on the negative headset output channel by said control signal.

9. The apparatus of claim 1, further comprising:

a hook switch detection circuit configured to detect a state of a hook switch coupled through said jack connection to the signal line and generate a second connection signal; and an additional gating circuit configured to pass said second connection signal for output as a hook switch connected signal in response to said gating signal.

10. The apparatus of claim 9, wherein the headset detection circuit comprises:

a first detection circuit coupled to a positive headset output channel of the headset and comprising a first comparator configured to compare a signal on the positive headset output channel to a first reference and generate a positive headset detect signal; and a second detection circuit coupled to a negative headset output channel of the headset and comprising a second comparator configured to compare a signal on the negative headset output channel to a second reference and generate a negative headset detect signal;

wherein the gating signal represents assertion of both the positive and negative headset detect signals.

11. The apparatus of claim 10, wherein each of the first and second detection circuits further comprises:

a flip-flop having a data input coupled to an output of the respective first or second comparator; and a switching circuit configured to selectively pass either an output from the flip-flop or the output of the first or second comparator as the positive or negative, respectively, headset detect signal in response to whether the flip-flop has been enabled.

12. The apparatus of claim 9, wherein the hook switch detection circuit comprises a comparator configured to compare a voltage on said signal line to a reference and generate the second connection signal responsive to said comparison.

13. The apparatus of claim 12, wherein the hook switch detection circuit further comprises a pull-up resistor selectively coupled to said signal line in response to an enable signal.

14. The apparatus of claim 13, wherein each of the first and second detection circuits further comprises:

a flip-flop having a data input coupled to an output of the respective first or second comparator and a clock input responsive to said enable signal; and a switching circuit configured to selectively pass either an output from the flip-flop or the output of the first or second comparator as the positive or negative, respectively, headset detect signal in response to whether the flip-flop has been enabled.

15. The apparatus of claim 1, wherein the microphone detection circuit further comprises a pull-up resistor selectively coupled to said signal line in response to said enable signal.

16. An apparatus, comprising:

a microphone detection circuit configured to detect connection of a microphone to a signal line through a jack connection and generate a first connection signal;

a headset detection circuit configured to detect connection of a headset through said jack connection and generate a gating signal; and a gating circuit configured to pass said first connection signal for output as a headset connected signal in response to said gating signal;

wherein the headset detection circuit comprises:

a first detection circuit coupled to a positive headset output channel of the headset and comprising a first comparator configured to compare a signal on the positive headset output channel to a first reference and generate a positive headset detect signal; and a second detection circuit coupled to a negative headset output channel of the headset and comprising a second comparator configured to compare a signal on the negative headset output channel to a second reference and generate a negative headset detect signal; and wherein the gating signal represents assertion of both the positive and negative headset detect signals.

17. The apparatus of claim 16, wherein the first detection circuit further comprises:

a flip-flop having a data input coupled to an output of the first comparator; and a switching circuit configured to selectively pass either an output from the flip-flop or the output of the first comparator as the positive headset detect signal in response to whether the flip-flop has been enabled.

18. The apparatus of claim 17, wherein the positive headset detect signal is selectively gated in response to whether a pull up on the positive headset output channel has been actuated in response to a pull-up control signal.

19. The apparatus of claim 18, further comprising a pull-up circuit including said pull up which is selectively actuated on the positive headset output channel by said pull-up control signal.

20. The apparatus of claim 16, wherein the second detection circuit further comprises:

a flip-flop having a data input coupled to an output of the second comparator; and a switching circuit configured to selectively pass either an output from the flip-flop or the output of the second comparator as the negative headset detect signal in response to whether the flip-flop has been enabled.

21. The apparatus of claim 20, wherein the negative headset detect signal is selectively gated in response to whether a pull up on the negative headset output channel has been actuated in response to a control signal.

22. The apparatus of claim 21, further comprising a pull-up circuit including said pull up which is selectively actuated on the negative headset output channel by said control signal.

23. An apparatus, comprising:

a microphone detection circuit configured to detect connection of a microphone to a signal line through a jack connection and generate a first connection signal;

a headset detection circuit configured to detect connection of a headset through said jack connection and generate a gating signal;

a gating circuit configured to pass said first connection signal for output as a headset connected signal in response to said gating signal;

a hook switch detection circuit configured to detect a state of a hook switch coupled through said jack connection to the signal line and generate a second connection signal; and an additional gating circuit configured to pass said second connection signal for output as a hook switch connected signal in response to said gating signal.

24. The apparatus of claim 23, wherein the headset detection circuit comprises:

a first detection circuit coupled to a positive headset output channel of the headset and comprising a first comparator configured to compare a signal on the positive headset output channel to a first reference and generate a positive headset detect signal; and a second detection circuit coupled to a negative headset output channel of the headset and comprising a second comparator configured to compare a signal on the negative headset output channel to a second reference and generate a negative headset detect signal;

wherein the gating signal represents assertion of both the positive and negative headset detect signals.

25. The apparatus of claim 24, wherein each of the first and second detection circuits further comprises:

a flip-flop having a data input coupled to an output of the respective first or second comparator; and a switching circuit configured to selectively pass either an output from the flip-flop or the output of the first or second comparator as the positive or negative, respectively, headset detect signal in response to whether the flip-flop has been enabled.

26. The apparatus of claim 23, wherein the hook switch detection circuit comprises a comparator configured to compare a voltage on said signal line to a reference and generate the second connection signal responsive to said comparison.

27. The apparatus of claim 26, wherein the hook switch detection circuit further comprises a pull-up resistor selectively coupled to said signal line in response to an enable signal.

28. The apparatus of claim 27, wherein each of the first and second detection circuits further comprises:

a flip-flop having a data input coupled to an output of the respective first or second comparator and a clock input responsive to said enable signal; and a switching circuit configured to selectively pass either an output from the flip-flop or the output of the first or second comparator as the positive or negative, respectively, headset detect signal in response to whether the flip-flop has been enabled.

29. A method, comprising:

detect a connection of a microphone to a signal line through a jack connection to generate a first connection signal by using a logic gate to combine a voltage on a microphone line with an enable signal;

compare a first signal on a first headset output channel to a first reference value and assert a first headset detect signal based thereupon;

compare a second signal on a second headset output channel to a second reference value and assert a second headset detect signal based thereupon;

output the first connection signal through a gating circuit as a function of the first and second headset detect signals.

30. The method of claim 29, wherein the first headset detect signal is asserted as a function of the first signal being less than the first reference value; and wherein the second headset detect signal is asserted as a function of the second signal being less than the second reference value.

31. The method of claim 29, wherein the first headset output channel comprises a positive headset output channel; and wherein the second headset output channel comprises a negative headset output channel.

* * * * *